US006529134B2

(12) United States Patent
Machen et al.

(10) Patent No.: US 6,529,134 B2
(45) Date of Patent: Mar. 4, 2003

(54) REMOTE ADJUSTMENT DEVICE AND METHOD

(75) Inventors: Joel L. Machen, Cypress, TX (US); John F. Hirschbuehler, Houston, TX (US)

(73) Assignee: HMT, Inc., Tomball, TX (US)

( * ) Notice: Subject to any disclaimer, the term of this patent is extended or adjusted under 35 U.S.C. 154(b) by 127 days.

(21) Appl. No.: 09/813,560

(22) Filed: Mar. 21, 2001

(65) Prior Publication Data

US 2002/0135473 A1 Sep. 26, 2002

(51) Int. Cl.[7] ..... G08B 21/00

(52) U.S. Cl. ..... 340/623; 340/624; 220/216; 220/220

(58) Field of Search ..... 340/612, 615, 340/618, 623, 624; 29/421.1, 454; 405/171, 176; 220/216, 218, 220, 222

(56) References Cited

U.S. PATENT DOCUMENTS

| | | | | | |
|---|---|---|---|---|---|
| 3,902,239 | A | * | 9/1975 | Hirota | 29/454 |
| 4,400,112 | A | * | 8/1983 | Castel et al. | 405/224 |
| 5,228,339 | A | * | 7/1993 | Maresca, Jr. et al. | 73/290 V |
| 5,230,436 | A | * | 7/1993 | Vaughn | 220/220 |
| 5,353,941 | A | * | 10/1994 | Benvegnu et al. | 220/220 |
| 5,628,421 | A | * | 5/1997 | Jolly | 220/216 |
| 6,290,083 | B1 | * | 9/2001 | Witter et al. | 220/220 |

* cited by examiner

*Primary Examiner*—Van Trieu
(74) *Attorney, Agent, or Firm*—R. Perry McConnell

(57) ABSTRACT

The invention provides a device and method for remotely selectively securing a floating tank roof in a desired position.

14 Claims, 5 Drawing Sheets

REMOTE ADJUSTMENT DEVICE AND METHOD

TECHNICAL FIELD

The invention concerns a device and method for remotely selectively securing a floating tank roof in a desired position.

BACKGROUND OF THE INVENTION

Above ground storage tanks are frequently used to store hydrocarbon liquids. When the stored liquid is volatile, the storage tank is usually equipped with a floating roof, which floats on top of the stored liquid and moves up and down with the liquid level. Floating roofs greatly reduce liquid evaporation, preventing loss of the stored liquid and reducing pollution due to hydrocarbon evaporation into the atmosphere.

Such floating roofs are generally provided with support legs which are usually spaced about twenty feet apart and provide support to the roof when the roof is not floating on stored liquid, such as when the tank is emptied or taken out of service for maintenance. It is desirable for the roof to be allowed to drop to within about three feet of the floor during product storage. However, if it is necessary for personnel to enter an empty tank, three feet of clearance between the roof and the floor is insufficient.

Accordingly, floating roof support leg assemblies often comprise a sleeve which penetrates the roof and is securely attached thereto, and which provides a longitudinal cavity. Such support leg assemblies also comprise a sliding leg which slides through the longitudinal cavity of the sleeve. The sleeve extends about three feet, or the minimum desired landing height of the roof, below the bottom surface of the roof. The roof can be landed on, and supported by, the sleeves if the lower landing position is desired. In this configuration, the sliding legs are allowed to slide freely upward through the longitudinal cavities of the sleeves and do not interfere with the downward positioning of the roof.

As the roof floats upward, the sliding legs slide downward through the longitudinal cavities of the sleeves. If the sliding legs are sufficiently short, and the tank sufficiently tall, the roof could float to a position from which the sliding legs would fall out of the sleeves. Accordingly, the sliding legs can be provided with a cap or another stoppage device, such as pins, which prevent the tops of the sliding legs from sliding downward through the sleeves.

Positioning holes cut through both the sleeves and the sliding legs can be set so that they are aligned when the sliding legs extend below the base of the roof a desired distance, such as six feet, or some other height sufficient to allow personnel access into the tank. With the roof floating at approximately the desired height above the storage tank floor, and with the positioning holes in the sleeves and the sliding legs aligned, the sliding legs can be locked into position relative to the sleeves by inserting locking pins essentially horizontally through the aligned holes. Thus, as the storage tank is emptied and the roof lowers, it will be landed in a high roof position on the bases of the sliding legs at the desired height above the storage tank floor.

Current systems which provide this type of floating roof height adjustment require that the locking pins be set by hand. This requirement results in labor costs which must be incurred every time the high roof position must be obtained over an empty storage tank. Further, governmental safety regulations often preclude allowing workers onto a floating roof when the storage tank is in service, so that setting up the roof to obtain the high roof position requires: (1) emptying the tank and landing the roof on the sleeves (the low roof position); (2) refilling the tank with water until the positioning holes in the sleeves and the sliding legs are aligned; (3) manually setting the locking pins; (4) emptying the tank a second time, landing the roof on the sliding legs (the high roof position); (5) performing the necessary work inside the tank; (6) refilling the tank with water again to float the roof; (7) manually removing the locking pins; (8) emptying the water from the tank; and (9) refilling the tank with stored product.

Even if the tank is filled with water during the manual setting and removal of the locking pins, safety regulations may require that personnel on the tank roof be provided with breathing apparatus, which increases the expense of such an operation and requires larger crews to provide the specialized services required.

Accordingly, it is desirable to provide a device which can set and remove locking pins under remote control, and without requiring the repeated and expensive process of draining the tank and refilling it with water to allow the roof height to be set.

BRIEF DISCLOSURE OF THE INVENTION

The invention provides a locking pin setting mechanism for a storage tank floating roof which is remotely actuatable, and which will reliably allow the floating roof to be positioned for a landing on its sliding legs as opposed to its sleeves. The invention comprises a plurality of pneumatic cylinders, each of which is securely attached to, or securely positioned relative to, one of the sleeves. Each pneumatic cylinder controls the essentially horizontal position of a locking pin, and is positioned relative to its respective sleeve so that actuation of the pneumatic cylinder will move the locking pin into, or out of, a positioning hole cut essentially horizontally through the sleeve.

The invention also comprises a plurality of sliding legs, each of which also comprises a positioning hole cut essentially horizontally through it. The sliding legs are inserted through the longitudinal cavities in the sleeves so that, when the positioning holes in the sleeves are aligned with the positioning holes in the sliding legs and the locking pins are inserted through these holes, the floating roof may be landed on the sliding legs and securely maintained at a height sufficiently above the tank floor so that personnel can safely enter the tank. After the personnel exit the tank and the tank is refilled, the pneumatic cylinders may be remotely actuated to withdraw the locking pins and again allow the floating roof to obtain its full vertical range of motion.

Because it is desirable to be able to set the locking pins without emptying the stored liquid from the tank, or to withdraw the locking pins with the stored liquid, rather than water, in the tank, the preferred embodiment of the invention uses spark-free pneumatic cylinders to position the locking pins. As those of skill in the art will recognize, other actuating devices, such as mechanical, electro-mechanical, or electrical devices may be used to position the locking pins. However, such devices may create sparks through either electrical discharge or mechanical friction, thereby presenting a safety hazard.

Each sliding leg of the preferred embodiment also comprises an essentially cylindrical sleeve positioned essentially horizontally through the sliding leg and aligned with the sliding leg positioning holes. This essentially horizontal sleeve assists in guiding the locking pin during the insertion of the locking pin through the positioning holes in the sleeve and the sliding leg. Preferably, the sleeve is secured in position relative to the sliding leg positioning holes by welding the sleeve to the sliding leg at both ends of the sleeve. However, the sleeve can also be supported internal to the sliding leg by providing horizontal or vertical supports which are in turn secured to the sliding leg. Further, in the preferred embodiment, each locking pin comprises a tapered end which is the lead end of the locking pin during the process of inserting the locking pin through the positioning holes in the sleeve and the sliding leg. Such a tapered end aids in preventing mis-alignment of the locking pin with the positioning holes and thereby decreases the likelihood of jamming the locking pin.

It is also part of the preferred embodiment to provide a visual indicator, for example, reflective paint, on the portion of the locking pin at and near the tapered end. Such a visual indicator allows someone above and outside of the storage tank to visually verify that the locking pins are inserted through the positioning holes in the sleeves and the sliding legs. Those of skill in the art will recognize that other visual indicators than paint may be used for this purpose, including by way of example and without limitation, reflective tape.

The preferred embodiment also includes a failsafe warning system to alert someone outside the storage tank if the locking pins fail to activate and engage properly. Such a warning system may be provided by including a switch located in the pneumatic system which will trigger an alarm signal on the control panel at the pneumatic air or nitrogen source if the locking pins fail to activate.

Implementation of the preferred embodiment of the present invention includes providing a pneumatic distribution system with multiple branches, so that each branch provides pneumatic pressure to a group of the remote adjustment devices of the present invention. Because supporting a floating roof will require multiple support point, a plurality of the remote adjustment devices of the present invention will be secured to the floating roof, usually in a grid-like pattern. By providing a pneumatic control system which includes branches such that each branch provides pneumatic control to a group of one or more of the remote adjustment devices used, the pneumatic control system provides for useable operation even if a malfunction causes loss of functionality in one of the branches. This distributed control system can thus allow the floating roof to be locked into the high position and repairs or maintenance to be performed on the pneumatic system after the tank has been drained and taken out of service.

DESCRIPTION OF THE PREFERRED EMBODIMENT

Figure 2:
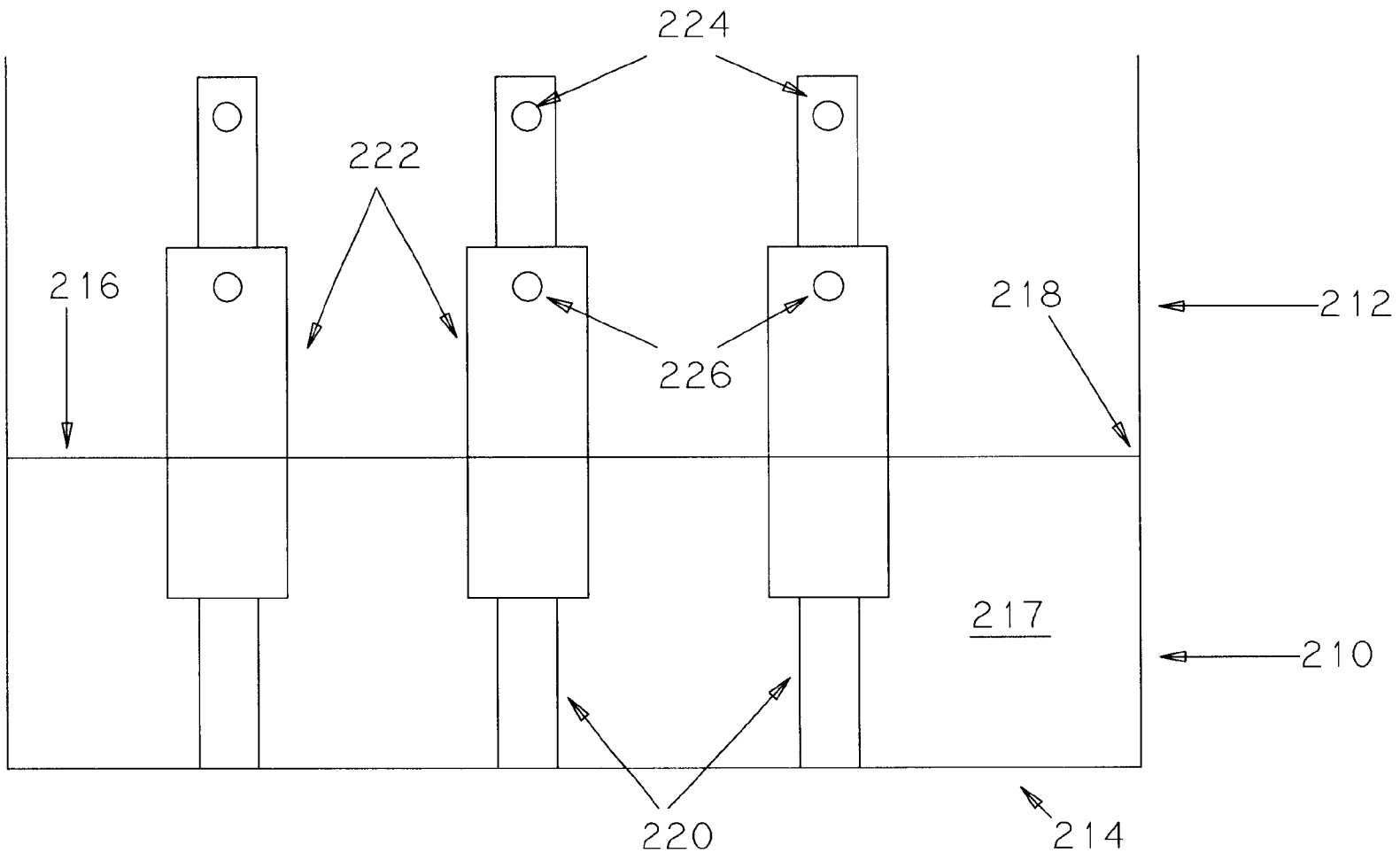
FIG. 2 is a schematic representation of a selectively positionable floating tank roof.

Referring to FIG. 2, a schematic representation of the sliding legs and sleeves of the remote adjustment system are shown. A storage tank 210 comprises a storage tank wall 212 and a floating roof 216. It is generally known to provide a gap seal around the edge 218 of the floating roof 216 to prevent unnecessary evaporation of the stored liquid from the storage tank 210. The stored liquid is contained in the space 217 between the floating roof 216 and the storage tank floor 214. To provide adjustable landing heights for the floating roof 216 when the storage tank 210 is empty, sleeves 222 which penetrate the floating roof 216 are secured to the floating roof 216. The sleeves 222 are usually arrayed in a grid pattern, and are spaced to provide sufficient support to the floating roof 216 when the weight of the floating roof 216 is landed on the sleeves 222 in a low roof position. The sleeves 222 also comprise longitudinal cavities (not shown), through which sliding legs 220 are positioned. Positioning holes 226 in the sleeves 222 are designed to allow them to align with sliding leg positioning holes 224, so that locking pins (not shown) can be inserted essentially horizontally through the aligned sets of sleeve positioning holes 226 and sliding leg positioning holes 224. With the locking pins so placed, the floating roof 216 cannot descend below a high roof position, because the sliding legs 220 will land on the floor 214 of the storage tank 210, and the locking pins (not shown) will prevent further descent of the sleeves 222 and thus the floating roof 216.

Figure 1A:
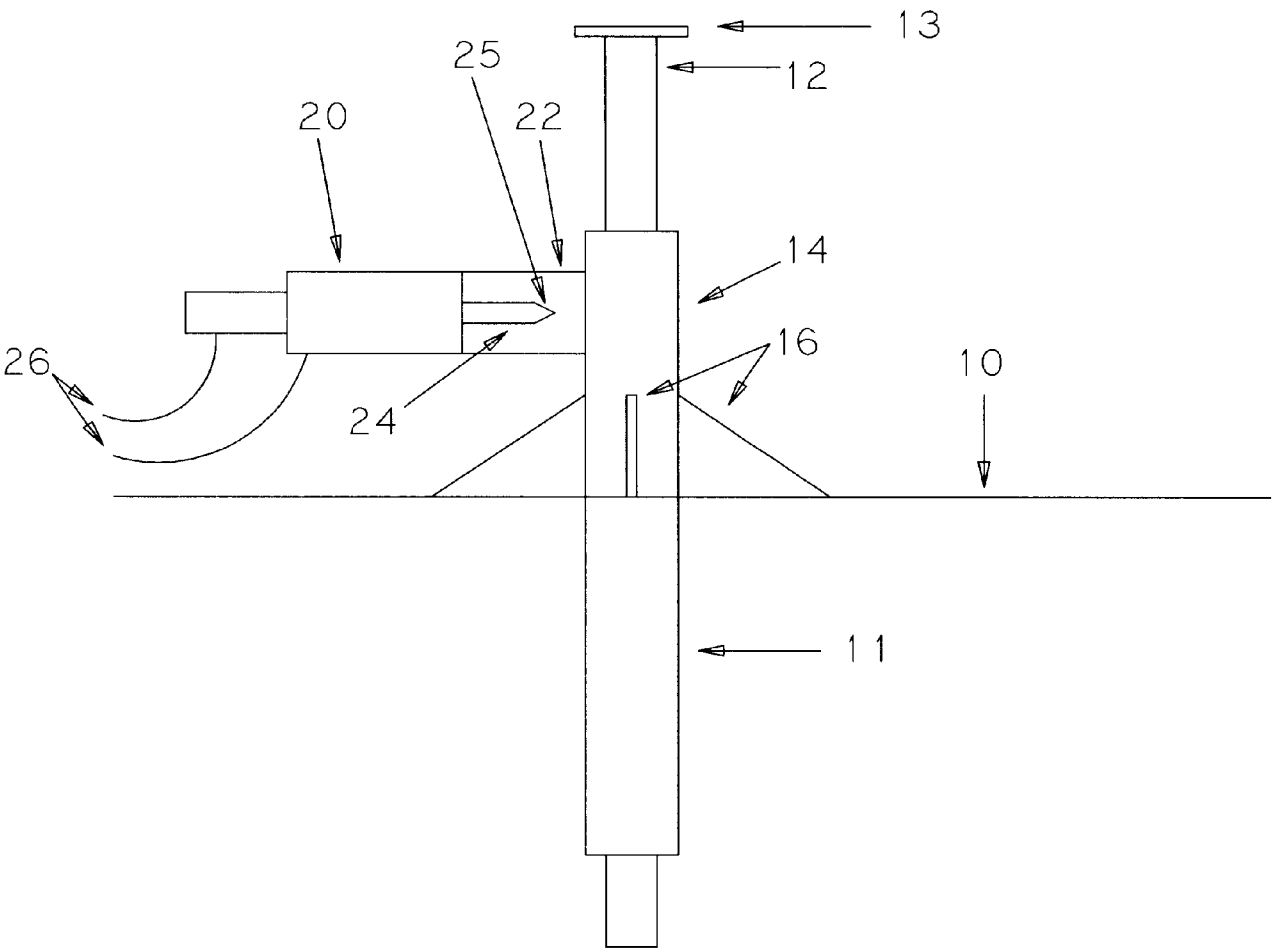
FIG. 1A is a side view of one embodiment of the remote adjustment device, with the sliding leg in the unlocked position.
Figure 1B:
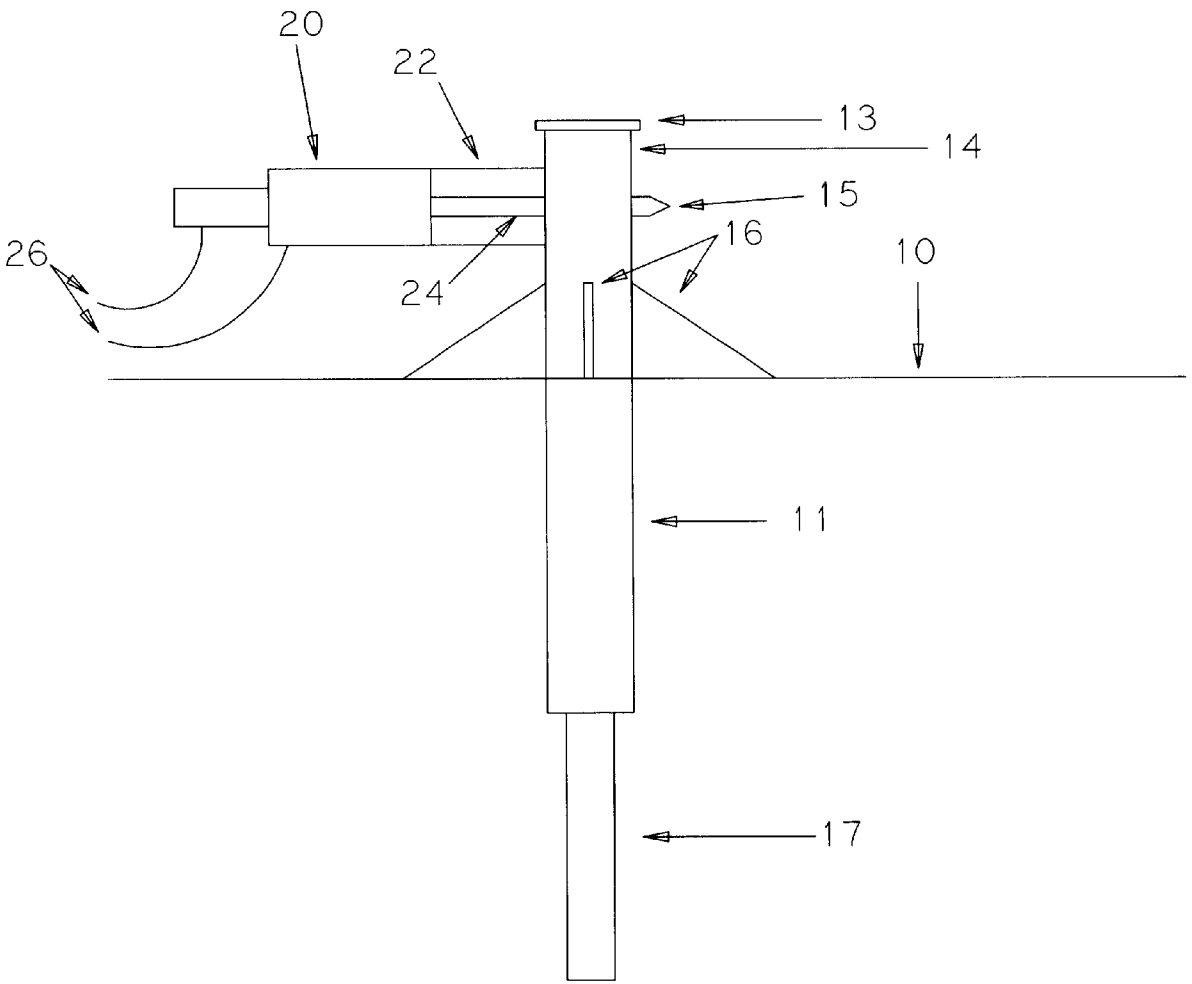
FIG. 1B is a side view of the embodiment of the remote adjustment device of FIG. 1A, with the sliding leg in the locked position.

Referring to FIGS. 1A and 1B, a side view of one embodiment of the present invention is shown. A sleeve 14 is securely attached to and penetrates a section of a floating roof 10. The sleeve 14 is stabilized by gussets 16 which are preferably made of steel or another high-strength, durable material. A sliding leg 12 is inserted through a longitudinal cavity (not shown) in the sleeve 14. Because the sliding leg 12 will generally be hollow, the sliding leg 12 is preferably provided with a cap 13 which precludes evaporation of stored liquid through the interior of the sliding leg 12 to the outer atmosphere. As those of skill in the art will recognize, such evaporation is preferably further limited by providing gaskets made of Buna-N, Viton, Teflon, or some other elastomeric material (not shown) at appropriate locations at the juncture of the sleeve 14, sliding leg 12, and cap 13, and that the optimal placement and shape of such gaskets will depend on the particular design of these elements.

The weight of the sliding leg 12 will also cause the sliding leg 12 to fall to its lowest possible point relative to the sleeve 14 unless the sliding leg 12 is locked into position relative to the sleeve 14 or unless the sliding leg 12 is in contact with the floor of the storage tank (not shown). Thus, the cap 13 also serves to position the sliding leg 12 relative to the sleeve 14 when the floating roof 10 is sufficiently high by blocking any further downward progress of the sliding leg 12 through the sleeve 14.

Although FIGS. 1A and 1B do not depict the sleeve positioning holes and the sliding leg positioning holes (Cf. FIG. 2, 226 and 224, respectively), those of skill in the art will recognize that the sleeve positioning holes (not shown) and the sliding leg positioning holes (not shown) will penetrate the sleeve 14 and the sliding leg 12, respectively, in the plane of FIG. 1, so that, when the sleeve positioning holes and the sliding leg positioning holes are aligned, a locking pin 24 can be inserted through the sleeve positioning holes and the sliding leg positioning holes as depicted in FIG. 1B, precluding relative vertical motion of the sleeve 14 and the sliding leg 12 (the locked position).

In the preferred embodiment, the sleeve 14 and the sliding leg 12 are made of square tubing, using carbon steel, stainless steel, aluminum, fiberglass, or other sufficiently strong materials which will provide an acceptable life span in a potentially hostile environment. Those of skill in the art will recognize that other configurations, such as cylindrical tubing, can be used. However, the use of square tubing prevents rotation of the sliding leg 12 relative to the sleeve 14 and aids in assuring proper alignment of the sleeve positioning holes and the sliding leg positioning holes.

A pneumatic cylinder 20 is mounted on an essentially rigid bracket 22, such as a section of rectangular steel tubing. Alternatively, the bracket 22 may be secured where practical, such as to a gusset 16 or to another supporting structure such as the floating roof 10 or the sleeve 14, so long as the pneumatic cylinder 20 is securely positioned relative to the sleeve 14. The pneumatic cylinder 20 is used to control the position of locking pin 24 which in turn will secure or release the relative vertical position of sleeve 14 and sliding leg 12 as described above. Thus, it is important that the position of the pneumatic cylinder 20 relative to the sleeve 14 be secured. In the preferred embodiment, additional bracing 22 provides further security for the positioning of the pneumatic cylinder 20. The pneumatic cylinder 20 is preferably constructed from stainless steel materials, with non-metallic parts made from Buna-N, Teflon, Viton, or other elastomeric materials.

Locking pin 24 preferably comprises a taper 25 to aid in insuring that the locking pin 24 properly transits through the sleeve positioning holes (not shown) and the sliding leg position holes (not shown) while being placed into the locked position. Additionally, it is preferred to apply reflective paint to area on and around the tip 15 of the locking pin 24, so that personnel can visually verify when locking pin 24 is fully extended into the locked position.

When locking pin 24 is retracted as depicted in FIG. 1A (the unlocked position), the sliding leg 12 will freely slide within sleeve 14, subject only to the downward limit imposed by cap 13. Thus, if the stored fluid level below the floating roof 10 drops sufficiently, the floating roof 10 will settle to be supported by the sleeve 14. Thus, the minimum height of the floating roof 10 above the floor of the storage tank (not shown) will be determined by the extent 11 of the sleeve 14 which extends below the floating roof 10.

When the floating roof 10 is floating sufficiently high, the sliding leg 12 will have dropped completely into the sleeve 14, prevented from falling any further by the cap 13. In this position, the sleeve positioning holes (not shown) and the sliding leg positioning holes (not shown) are aligned and the remote adjustment system may be placed into the locked position by remotely controlling the pneumatic pressure in control lines 26, causing the pneumatic cylinder 20 activate locking pin 24 to move forward into the locked position as depicted in FIG. 1B. In the locked position, the floating roof 10 will be held at a minimum height off of the storage tank floor (not shown) by the extent 17 of the sliding leg 12 which extends below the floating roof 10. As those of skill in the art will recognize, the floating roof 10 can be subsequently re-floated, and the pneumatic pressure in control lines 26 can be remotely controlled to cause pneumatic cylinder 20 to retract locking pin 24, returning the remote adjustment system to the unlocked position.

Figure 3B:
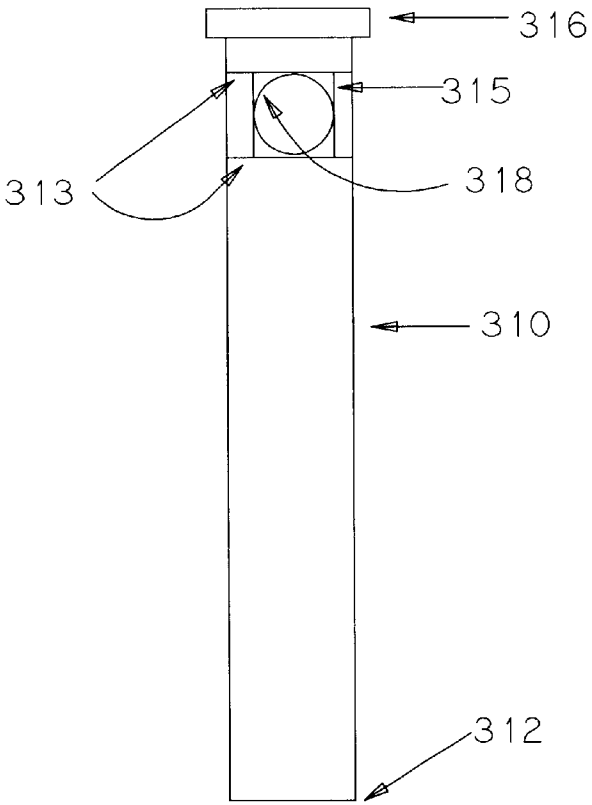
FIG. 3B is a cross-sectional view of the sliding leg shown in FIG. 3A, sectioned corresponding to plane A—A of FIG. 3A.
Figure 3A:
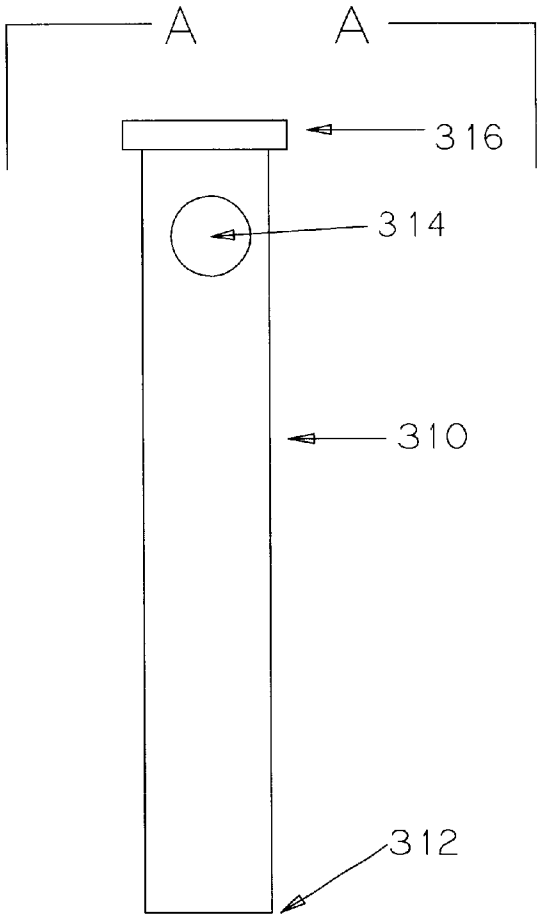
FIG. 3A is a side view of one embodiment of a sliding leg of the present invention.

Referring to FIGS. 3A and 3B, an embodiment of the sliding leg comprises a tubular member 310, which has a base 312 and is topped by a cap 316. Sliding leg positioning holes 314 provide a passageway for transit of the locking pin, as discussed above. It is preferred to provide a cylindrical guide 318 which extends through the body of the sliding leg 310, to prevent the locking pin from entering one of the sliding leg positioning holes 314, then becoming misaligned and jamming against the far side of the sliding leg 310. The cylindrical guide 318 is preferably directly attached to the sliding leg 310, as by welding or other direct attachment methods known to those of skill in the art. Alternatively, the cylindrical guide 318 may be supported by essentially horizontal supports 313 and essentially vertical supports 315. If so used, the horizontal supports 313 can provide the added benefit of aiding in sealing the sliding leg to prevent evaporation of stored fluid.

Figure 4:
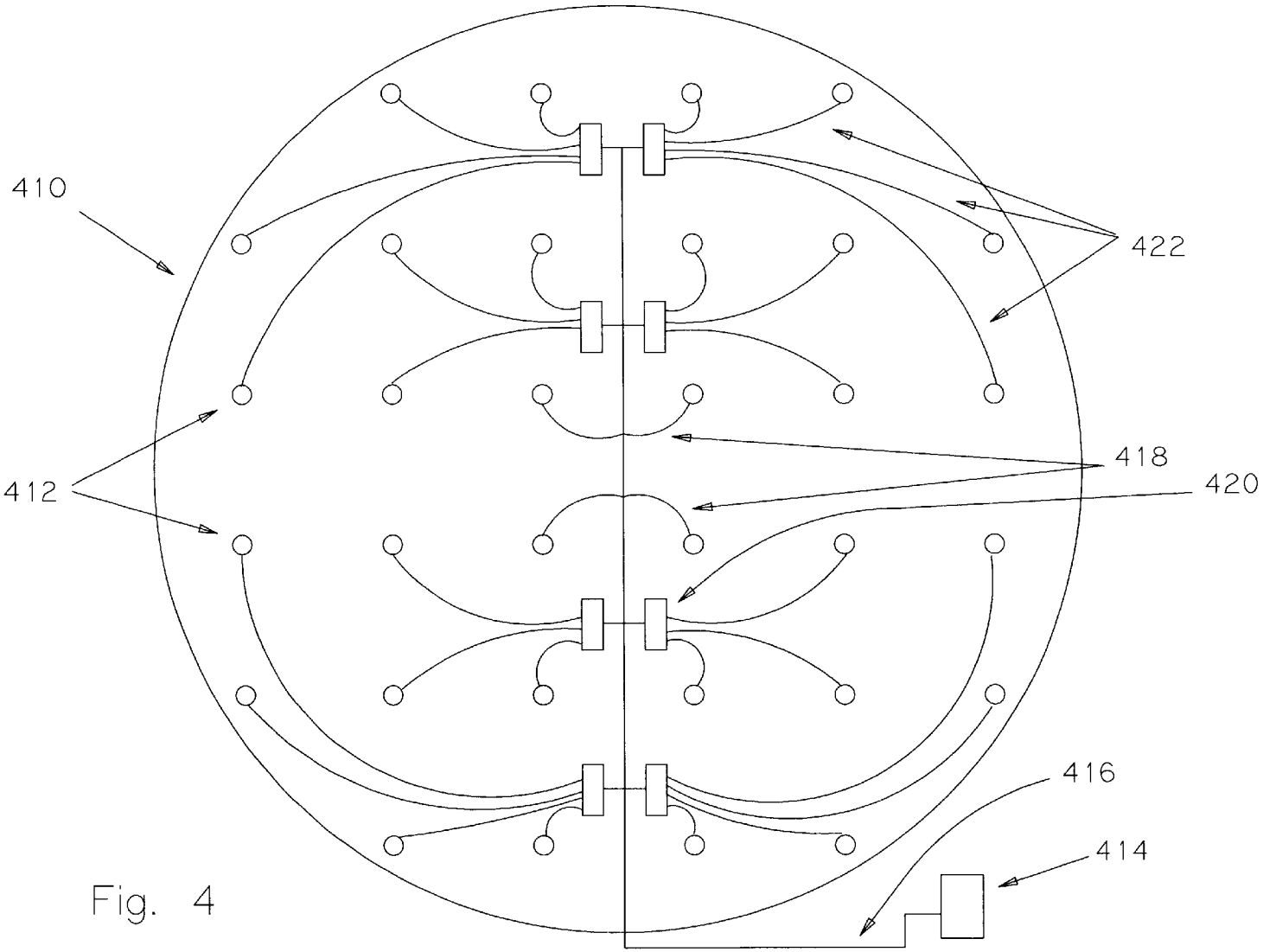
FIG. 4 is a schematic representation of the top of a floating roof equipped with the remote adjustment device of the present invention.

Referring to FIG. 4, a schematic top view of a floating roof 410 utilizing the present invention is shown. The floating roof 410 comprises an array of remote adjustment devices as described above, as depicted by circles 412. A pneumatic pressure source 414, such as a compressor, a tank of compressed air, or a supply of compressed nitrogen, provides pneumatic pressure to a pneumatic line 416, which is subsequently connected to pneumatic control lines 418 and 422, either directly or through distribution points 420. Use of distribution points 420 allows parallel control of pneumatic pressure to the remote adjustment devices, so that if one node or branch of the pneumatic distribution system fails, the other nodes or branches can remain functional, thus allowing sufficient locking pins to be moved to the locked position to allow the floating roof 410 to be safely landed in the high position.

In the preferred embodiment, the pneumatic distribution system will be enclosed in conduit type housing and connected to the floating roof 410 with magnetic component parts, so that the pneumatic distribution system will not cause an undue hazard to personnel.

As those of skill in the art will recognize, normal variations on this system may be necessary. If the pneumatic pressure source 414 is a source of compressed air, addition of a water filter to the pneumatic distribution system will be necessary. Further, control of the pneumatic distribution system will require the use of valves and connectors which are a matter of engineering choice.

Those of skill in the art will recognize that variations of the above description may be made without departing from the scope and spirit of this invention, and this invention shall not be unduly limited to these illustrative embodiments.

We claim:

1. A device for remotely securing a floating tank roof in a desired position, comprising a plurality of sleeves, each sleeve comprising an inner longitudinal cavity and a sleeve positioning hole, wherein said sleeves are secured to and penetrate the floating tank roof which is to be secured, a plurality of sliding legs, each sliding leg comprising a sliding leg positioning hole, and wherein each of said sliding legs is slideably positionable into said inner longitudinal cavity of one of said sleeves, and a plurality of locking pins, wherein at least one of said locking pins is selectively and remotely positionable through one of said sleeve positioning holes and one of said sliding leg positioning holes simultaneously.

2. The device of claim 1, wherein at least one of said locking pins has a tapered end.

3. The device of claim 1, additionally comprising a plurality of pneumatic cylinders, wherein said pneumatic cylinders are remotely activatible to control the position of said locking pins.

4. The device of claim 3, wherein at least one of said pneumatic cylinders is activated by pressurized air.

5. The device of claim 3, wherein at least one of said pneumatic cylinders is activated by pressurized nitrogen.

6. The device of claim 1, wherein at least one end of said locking pins comprises a visually prominent indicator.

7. The device of claim 6, wherein said visually prominent indicator is a reflective paint.

8. The device of claim 1, additionally comprising a source of pneumatic pressure, wherein said source of pneumatic pressure is controllable to provide said selective and remote control of at least one of said locking pins.

9. The device of claim 8, wherein said source of pneumatic pressure is a tank of compressed air.

10. The device of claim 8, wherein said source of pneumatic pressure is a tank of compressed nitrogen.

11. The device of claim 8, wherein said source of pneumatic pressure is a compressor.

12. The device of claim 1, additionally comprising a branched control system, wherein activation of said branched control system accomplishes said selective and remote control of at least one of said locking pins.

13. The device of claim 12, wherein a failure of one portion of said branched control system does not preclude the remainder of said branched control system from functioning.

14. The device of claim 1, additionally comprising a warning device, wherein said warning device activates if at least one of said locking pins fails to activate or engage properly.

* * * * *